US007864123B2

(12) United States Patent
Hill et al.

(10) Patent No.: US 7,864,123 B2
(45) Date of Patent: Jan. 4, 2011

(54) HYBRID SLOT ANTENNAS FOR HANDHELD ELECTRONIC DEVICES

(75) Inventors: Robert J. Hill, Salinas, CA (US); Juan Zavala, Watsonville, CA (US)

(73) Assignee: Apple Inc., Cupertino, CA (US)

( * ) Notice: Subject to any disclaimer, the term of this patent is extended or adjusted under 35 U.S.C. 154(b) by 334 days.

(21) Appl. No.: 11/897,033

(22) Filed: Aug. 28, 2007

(65) Prior Publication Data

US 2009/0058735 A1 Mar. 5, 2009

(51) Int. Cl.
*H01Q 1/24* (2006.01)

(52) U.S. Cl. ..... 343/702; 343/767

(58) Field of Classification Search ..... 343/702, 343/700 MS, 767
See application file for complete search history.

(56) References Cited

U.S. PATENT DOCUMENTS

| | | | | |
|---|---|---|---|---|
| 6,424,300 | B1 | 7/2002 | Sanford | |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,856,294 | B2 | 2/2005 | Kadambi et al. | |
| 6,980,154 | B2 | 12/2005 | Vance et al. | |
| 7,027,838 | B2 | 4/2006 | Zhou et al. | |
| 7,116,276 | B2 | 10/2006 | Lee | |
| 7,119,747 | B2 | 10/2006 | Lin et al. | |
| 7,123,208 | B2 | 10/2006 | Baliarda et al. | |
| 7,612,725 | B2 | 11/2009 | Hill et al. | |
| 2001/0052877 | A1* | 12/2001 | Honda et al. | 343/702 |
| 2003/0107518 | A1 | 6/2003 | Li et al. | |
| 2004/0017318 | A1 | 1/2004 | Annabi et al. | |
| 2004/0145521 | A1 | 7/2004 | Hebron et al. | |
| 2006/0055606 | A1 | 3/2006 | Boyle | |
| 2007/0030200 | A1* | 2/2007 | Heng et al. | 343/700 MS |
| 2008/0231521 | A1 | 9/2008 | Anguera Pros et al. | |
| 2010/0007564 | A1 | 1/2010 | Hill et al. | |

FOREIGN PATENT DOCUMENTS

| | | |
|---|---|---|
| EP | 0 851 530 | 7/1998 |
| EP | 1 351 334 A | 10/2003 |
| EP | 1 401 050 A | 3/2004 |

(Continued)

OTHER PUBLICATIONS

Hill et al. U.S. Appl. No. 11/650,187, filed Jan. 4, 2007.

(Continued)

*Primary Examiner*—Douglas W Owens
*Assistant Examiner*—Dieu Hien T Duong
(74) *Attorney, Agent, or Firm*—Treyz Law Group; G. Victor Treyz; David C. Kellogg

(57) ABSTRACT

Handheld electronic devices are provided that contain wireless communications circuitry. The wireless communications circuitry may include an antenna. The antenna may be formed from a ground plane having a dielectric-filled slot that defines a slot antenna structure and having a planar-inverted-F (PIFA) resonating element located above the opening. The slot antenna structure and the PIFA resonating element may both contribute to the performance of the antenna, so that the antenna exhibits the performance of a hybrid PIFA-slot antenna. The PIFA resonating element may contain multiple antenna resonating element branches. The branches may be configured to operate in different communications bands than the slot antenna structure.

22 Claims, 16 Drawing Sheets

FOREIGN PATENT DOCUMENTS

| | | | |
|---|---|---|---|
| GB | 2 301 485 | | 12/1996 |
| WO | 2004/001894 | A | 12/2003 |
| WO | WO2004/102744 | | 11/2004 |
| WO | 2005/109567 | A | 11/2005 |
| WO | WO 2006070017 | A1 * | 7/2006 |
| WO | WO2006/097496 | | 9/2006 |

OTHER PUBLICATIONS

Hill et al. U.S. Appl. No. 11/821,192, filed Jun. 21, 2007.

* cited by examiner

| | |
|---|---|
| BRANCH 1 | UMTS/PCS |
| SLOT | DCS |
| BRANCH 2 | GSM/EGSM |

FIG. 14

| SLOT | UMTS |
|---|---|
| BRANCH 1 | DCS/PCS |
| BRANCH 2 | GSM/EGSM |

FIG. 15

| | |
|---|---|
| BRANCH 1 | UMTS |
| BRANCH 2 | PCS |
| SLOT | DCS |
| BRANCH 3 | GSM/EGSM |

FIG. 16

| | |
|---|---|
| BRANCH 1 | UMTS |
| SLOT | PCS |
| BRANCH 2 | DCS |
| BRANCH 3 | GSM/EGSM |

FIG. 17

| SLOT | WIFI |
|---|---|
| BRANCH 1 | UMTS |
| BRANCH 2 | DCS/PCS |
| BRANCH 3 | GSM/EGSM |

FIG. 18

HYBRID SLOT ANTENNAS FOR HANDHELD ELECTRONIC DEVICES

BACKGROUND

This invention relates generally to wireless communications circuitry, and more particularly, to wireless communications circuitry for handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using cellular telephone bands at 850 MHz, 900 MHz, 1800 MHz, and 1900 MHz. Handheld electronic devices may also use short-range wireless communications links. For example, handheld electronic devices may communicate using the WiFi® (IEEE 802.11) band at 2.4 GHz and the Bluetooth® band at 2.4 GHz. Communications are also possible in data service bands such as the 3G data communications band at 2170 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Many devices use planar inverted-F antennas (PIFAs). Planar inverted-F antennas are formed by locating a planar resonating element above a ground plane. These techniques can be used to produce antennas that fit within the tight confines of a compact handheld device.

Although modern handheld electronic devices often need to function over a number of different communications bands, it is difficult to design a compact antenna that functions satisfactorily over a wide frequency range with satisfactory performance levels. For example, when the vertical size of conventional planar inverted-F antennas is made too small in an attempt to minimize antenna size, the bandwidth and gain of the antenna are adversely affected.

It would therefore be desirable to be able to provide improved antennas and wireless handheld electronic devices.

SUMMARY

Handheld electronic devices and wireless communications circuitry for handheld electronic devices are provided. The wireless communications circuitry may include an antenna. The antenna may include a ground plane having a dielectric-filled opening. The dielectric-filled opening may form a slot antenna structure. The antenna may also have a planar inverted-F antenna (PIFA) resonating element that is located above the opening. The PIFA antenna resonating element may contain multiple branches. The branches of the PIFA resonating element may be configured to operate in different communications bands than the slot antenna structure.

With one suitable arrangement, the PIFA antenna resonating element contains two branches. The slot antenna structure may be configured to operate in the Digital Cellular System (DCS) communications band at 1800 MHz. The first antenna resonating element branch may be configured to operate in the Universal Mobile Telecommunications System (UMTS) communications band at 2170 MHz and the Personal Communications Service (PCS) band at 1900 MHz. The second antenna resonating element branch may be configured to operate in the Global System for Mobile (GSM) communications band at 850 MHz and the Extended Global System for Mobile (EGSM) communications band at 900 MHz.

With another suitable two-branch arrangement, the slot antenna structure may be configured to operate in the Universal Mobile Telecommunications System (UMTS) communications band at 2170 MHz. The first antenna resonating element branch may be configured to operate in the Digital Cellular System (DCS) communications band at 1800 MHz and the Personal Communications Service (PCS) band at 1900 MHz. The second antenna resonating element branch may be configured to operate in the Global System for Mobile (GSM) communications band at 850 MHz and the Extended Global System for Mobile (EGSM) communications band at 900 MHz.

If desired, the PIFA resonating element structure may have three branches. In an illustrative arrangement of this type, the slot antenna structure may be configured to operate in the Digital Cellular System (DCS) communications band at 1800 MHz. The first antenna resonating element branch may be configured to operate in the Universal Mobile Telecommunications System (UMTS) communications band at 2170 MHz. The second antenna resonating element branch may be configured to operate in the Personal Communications Service (PCS) band at 1900 MHz. The third antenna resonating element branch may be configured to operate in the Global System for Mobile (GSM) communications band at 850 MHz and the Extended Global System for Mobile (EGSM) communications band at 900 MHz.

With another suitable three-branch arrangement, the slot antenna structure may be configured to operate in the Personal Communications Service (PCS) band at 1900 MHz. The first antenna resonating element branch may be configured to operate in the Universal Mobile Telecommunications System (UMTS) communications band at 2170 MHz. The second antenna resonating element branch may be configured to operate in the Digital Cellular System (DCS) communications band at 1800 MHz. The third antenna resonating element branch may be configured to operate in the Global System for Mobile (GSM) communications band at 850 MHz and the Extended Global System for Mobile (EGSM) communications band at 900 MHz.

If desired, a three-branch antenna resonating element arrangement may be used in which the slot antenna structure is configured to operate in a communications band at 2.4 GHz. The first antenna resonating element branch may be configured to operate in the Universal Mobile Telecommunications System (UMTS) communications band at 2170 MHz. The second antenna resonating element branch may be configured to operate in the Digital Cellular System (DCS) communications band at 1800 MHz and the Personal Communications Service (PCS) band at 1900 MHz. The third antenna resonating element branch may be configured to operate in the Global System for Mobile (GSM) communications band at 850 MHz and the Extended Global System for Mobile (EGSM) communications band at 900 MHz.

Further features of the invention, its nature and various advantages will be more apparent from the accompanying drawings and the following detailed description of the preferred embodiments.

BRIEF DESCRIPTION OF THE DRAWINGS

FIGS. 14 and 15 are tables showing how illustrative hybrid PIFA-slot antennas with two-branch multi-arm PIFA resonating elements may be configured to handle multiple communications bands in accordance with embodiments of the present invention.

FIG. 16, FIG. 17, and FIG. 18 are tables showing how illustrative hybrid PIFA-slot antennas with three-branch multi-arm PIFA resonating elements may be configured to handle multiple communications bands in accordance with embodiments of the present invention.

DETAILED DESCRIPTION

The present invention relates generally to wireless communications, and more particularly, to wireless electronic devices and antennas for wireless electronic devices.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
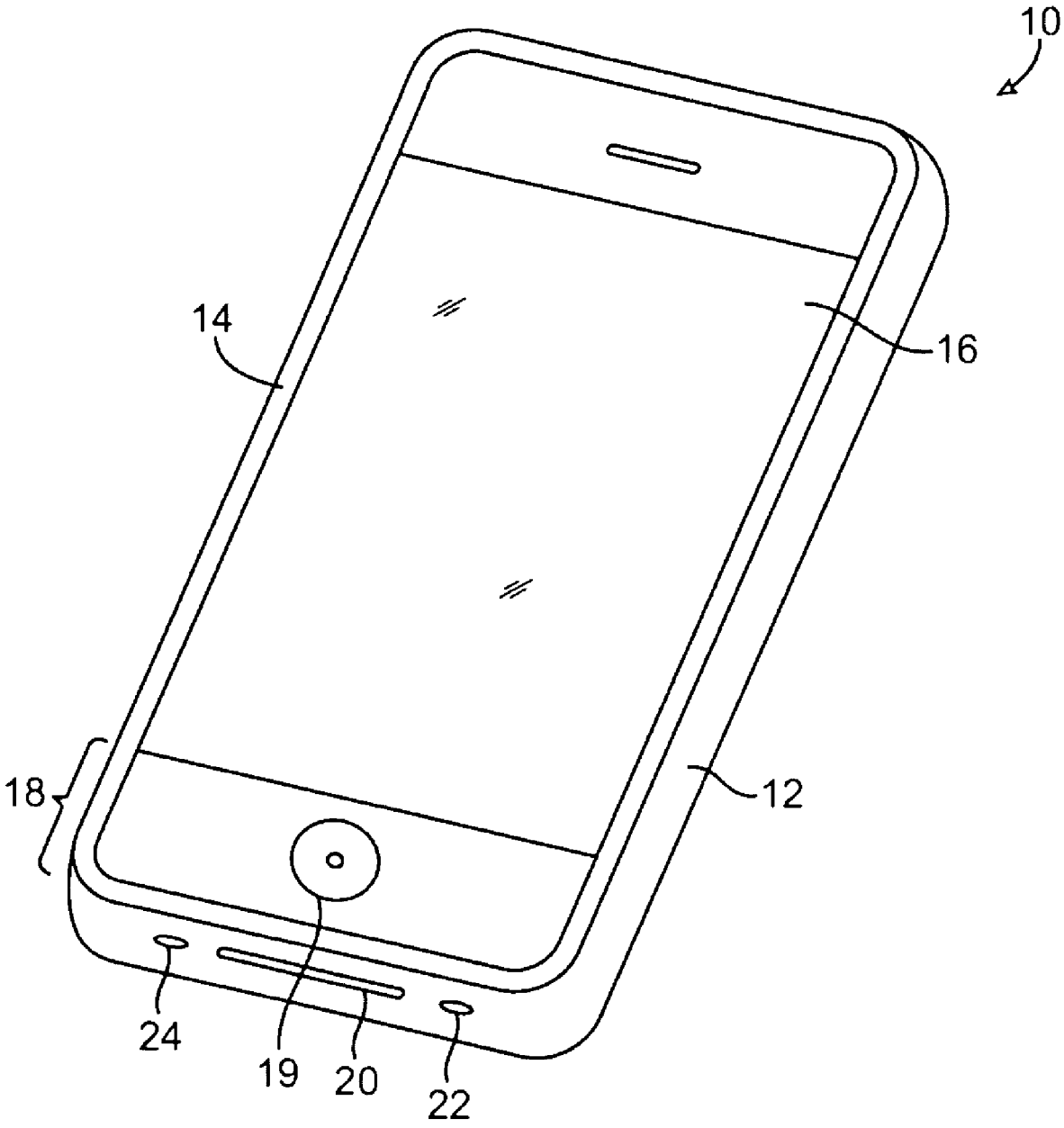
FIG. 1 is a perspective view of an illustrative handheld electronic device with an antenna in accordance with an embodiment of the present invention.

An illustrative handheld electronic device in accordance with an embodiment of the present invention is shown in FIG. 1. Device 10 may be any suitable portable or handheld electronic device.

Device 10 may have housing 12. Device 10 may include one or more antennas for handling wireless communications. Embodiments of device 10 that contain one antenna are sometimes described herein as an example.

Device 10 may handle communications over multiple communications bands. For example, wireless communications circuitry in device 10 may be used to handle cellular telephone communications in one or more frequency bands and data communications in one or more communications bands. With one suitable arrangement, which is sometimes described herein as an example, the wireless communications circuitry of device 10 is configured to handle data communications in a communications band centered at 2.4 GHz (e.g., WiFi and/or Bluetooth frequencies) and/or data communications in a 3G data band such as the UMTS band. The UMTS band may range from 1920-2170 MHz (sometimes referred to as 2170 MHz). Other data bands may also be supported instead of these data communications bands or in addition to these data communications bands. In configurations with multiple antennas, the antennas may be located at opposite ends of device 10 to reduce interference (as an example).

Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material, so that the operation of conductive antenna elements that are located in proximity to housing 12 is not disrupted. Housing 12 or portions of housing 12 may also be formed from conductive materials such as metal. An illustrative housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 may be shorted to an internal ground plane in device 10 to create a larger ground plane element for that device 10. To facilitate electrical contact between an anodized aluminum housing and other metal components in device 10, portions of the anodized surface layer of the anodized aluminum housing may be selectively removed during the manufacturing process (e.g., by laser etching).

Housing 12 may have a bezel 14. The bezel 14 may be formed from a conductive material. The conductive material may be a metal (e.g., an elemental metal or an alloy) or other suitable conductive materials. With one suitable arrangement, which is sometimes described herein as an example, bezel 14 may be formed from stainless steel. Stainless steel can be manufactured so that it has an attractive shiny appearance, is structurally strong, and does not corrode easily. If desired, other structures may be used to form bezel 14. For example, bezel 14 may be formed from plastic that is coated with a shiny coating of metal or other suitable substances.

Bezel 14 may serve to hold a display or other device with a planar surface in place on device 10. As shown in FIG. 1, for example, bezel 14 may be used to hold display 16 in place by attaching display 16 to housing 12. Device 10 may have front and rear planar surfaces. In the example of FIG. 1, display 16 is shown as being formed as part of the planar front surface of device 10. The periphery of the front surface may be surrounded by bezel 14. If desired, the periphery of the rear surface may be surrounded by a bezel (e.g., in a device with both front and rear displays).

Display 16 may be a liquid crystal diode (LCD) display, an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

In a typical arrangement, bezel 14 may have prongs that are used to secure bezel 14 to housing 12 and that are used to electrically connect bezel 14 to housing 12 and other conductive elements in device 10. The housing and other conductive elements form a ground plane for the antenna(s) in the handheld electronic device. A gasket (e.g., an o-ring formed from silicone or other compliant material, a polyester film gasket, etc.) may be placed between the underside of bezel 14 and the outermost surface of display 16. The gasket may help to relieve pressure from localized pressure points that might otherwise place stress on the glass or plastic cover of display 16. The gasket may also help to visually hide portions of the interior of device 10 and may help to prevent debris from entering device 10.

In addition to serving as a retaining structure for display 16, bezel 14 may serve as a rigid frame for device 10. In this capacity, bezel 14 may enhance the structural integrity of device 10. For example, bezel 14 may make device 10 more rigid along its length than would be possible if no bezel were used. Bezel 14 may also be used to improve the appearance of device 10. In configurations such as the one shown in FIG. 1 in which bezel 14 is formed around the periphery of a surface of device 10 (e.g., the periphery of the front face of device 10), bezel 14 may help to prevent damage to display 16 (e.g., by shielding display 16 from impact in the event that device 10 is dropped, etc.).

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports. Display screen 16 may be, for example, a liquid crystal display (LCD), an organic light-emitting diode (OLED) display, a plasma display, or multiple displays that use one or more different display technologies. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface devices such as button 19 and touch screen 16. Suitable user input interface devices for handheld electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown schematically as being formed on the top face of handheld electronic device 10 in the example of FIG. 1, buttons such as button 19 and other user input interface devices may generally be formed on any suitable portion of handheld electronic device 10. For example, a button such as button 19 or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device. Device 10 may also have audio and video jacks that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of handheld electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of handheld electronic device 10 to function properly without being disrupted by the electronic components.

With one suitable arrangement, the antenna resonating element structures of device 10 are located in the lower end 18 of device 10, in the proximity of port 20. An advantage of locating antenna resonating element structures in the lower portion of housing 12 and device 10 is that this places radiating portions of the antenna structures away from the user's head when the device 10 is held to the head (e.g., when talking into a microphone and listening to a speaker in the handheld device as with a cellular telephone). This reduces the amount of radio-frequency radiation that is emitted in the vicinity of the user and minimizes proximity effects.

Figure 2:
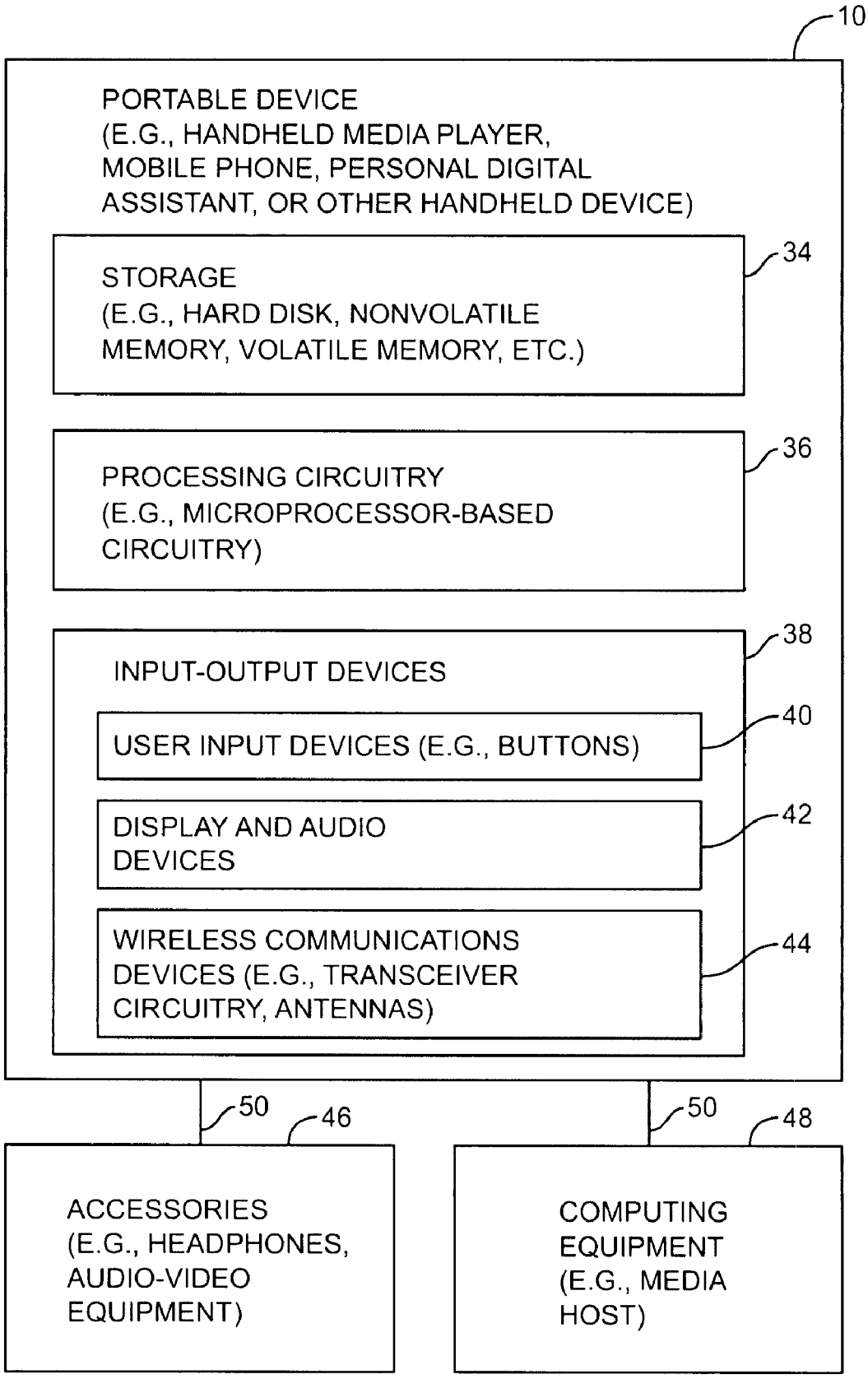
FIG. 2 is a schematic diagram of an illustrative handheld electronic device with an antenna in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as WiFi®), protocols for other short-range wireless communications links such as the Bluetooth® protocol, protocols for handling 3G data services such as UMTS, cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1550 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band.

Device 10 can cover these communications bands and/or other suitable communications bands with proper configuration of the antenna structures in wireless communications circuitry 44.

Figure 3:
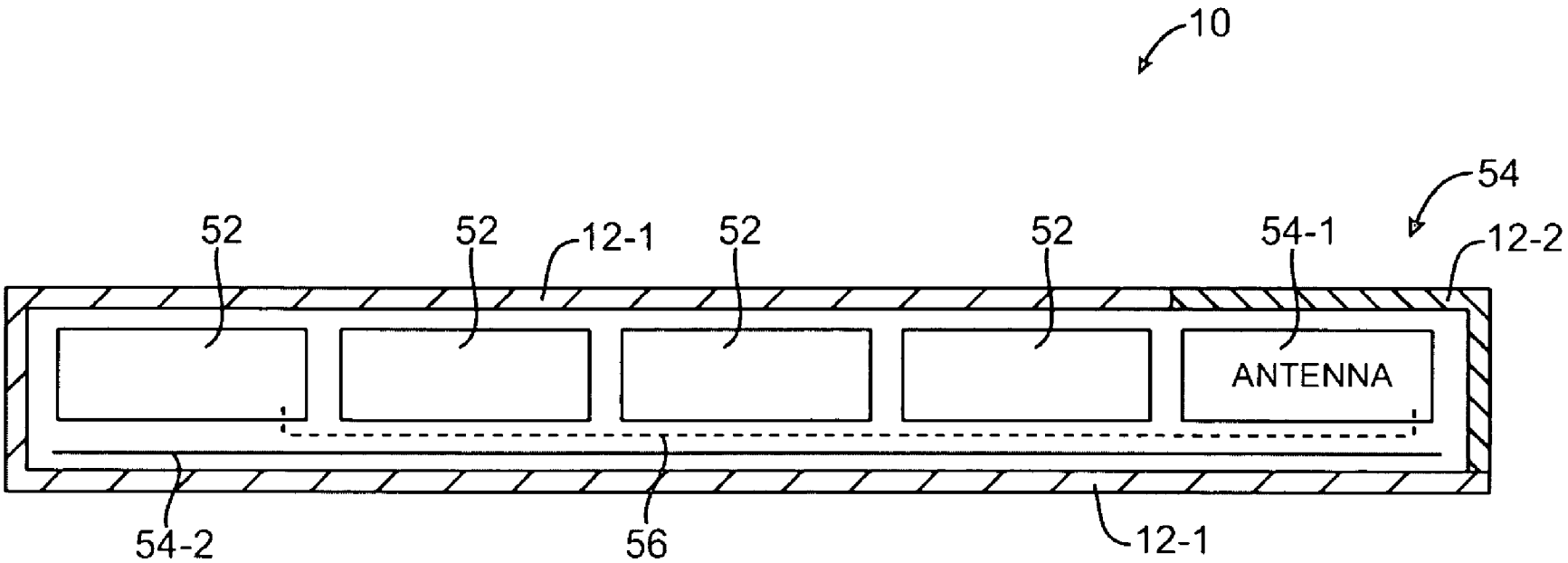
FIG. 3 is a cross-sectional side view of an illustrative handheld electronic device with an antenna in accordance with an embodiment of the present invention.

A cross-sectional view of an illustrative handheld electronic device is shown in FIG. 3. In the example of FIG. 3, device 10 has a housing that is formed of a conductive portion 12-1 and a plastic portion 12-2. Conductive portion 12-1 may be any suitable conductor such as aluminum, magnesium, stainless steel, alloys of these metals and other metals, etc.

Housing portion 12-2 may be formed from a dielectric. An advantage of using dielectric for housing portion 12-2 is that this allows a resonating element portion 54-1 of antenna 54 of device 10 to operate without interference from the metal sidewalls of housing 12. With one suitable arrangement, housing portion 12-2 is a plastic cap formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on circuit boards in device 10. The circuit board structures in device 10 may be formed from any suitable materials. Suitable circuit board materials include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are flexible circuit board materials such as polyimide, may also be used in device 10.

Typical components in device 10 include integrated circuits, LCD screens, and user input interface buttons. Device 10 also typically includes a battery, which may be mounted along the rear face of housing 12 (as an example).

Because of the conductive nature of components such as these and the printed circuit boards upon which these components are mounted, the components, circuit boards, and conductive housing portions (including bezel 14) of device 10 may be grounded together to form an antenna ground plane 54-2. With one illustrative arrangement, ground plane 54-2 may conform to the generally rectangular shape of housing 12 and device 10 and may match the rectangular lateral dimensions of housing 12.

Ground plane element 54-2 and antenna resonating element 54-1 form antenna 54 for device 10. If desired, other antennas can be provided for device 10 in addition to antenna 54. Such additional antennas may, if desired, be configured to provide additional gain for an overlapping frequency band of interest (i.e., a band at which antenna 54 is operating) or may be used to provide coverage in a different frequency band of interest (i.e., a band outside of the range of antenna 54).

Any suitable conductive materials may be used to form ground plane element 54-2 and resonating element 54-1 in antenna 54. Examples of suitable conductive materials for antenna 54 include metals, such as copper, brass, silver, and gold. Conductors other than metals may also be used, if desired. In a typical scenario, the conductive structures for resonating element 54-1 are formed from copper traces on a flex circuit or other suitable substrate.

Components 52 include transceiver circuitry (see, e.g., devices 44 of FIG. 2). The transceiver circuitry may be provided in the form of one or more integrated circuits and associated discrete components (e.g., filtering components). Transceiver circuitry may include one or more transmitter integrated circuits, one or more receiver integrated circuits, switching circuitry, amplifiers, etc. Each transceiver in transceiver circuitry may have an associated coaxial cable or other transmission line that is connected to antenna 54 and over which radio frequency signals are conveyed. In the example of FIG. 3, a transmission line is depicted by dashed line 56.

As shown in FIG. 3, the transmission line 56 may be used to distribute radio-frequency signals that are to be transmitted through the antenna from a transmitter integrated circuit 52 or other transceiver circuit to antenna 54. Path 56 may also be used to convey radio-frequency signals that have been received by antenna 54 to components 52. A receiver integrated circuit or other transceiver circuitry may be used to process incoming radio-frequency signals that have been conveyed from antenna 54 over one or more transmission lines 56.

Figure 4:
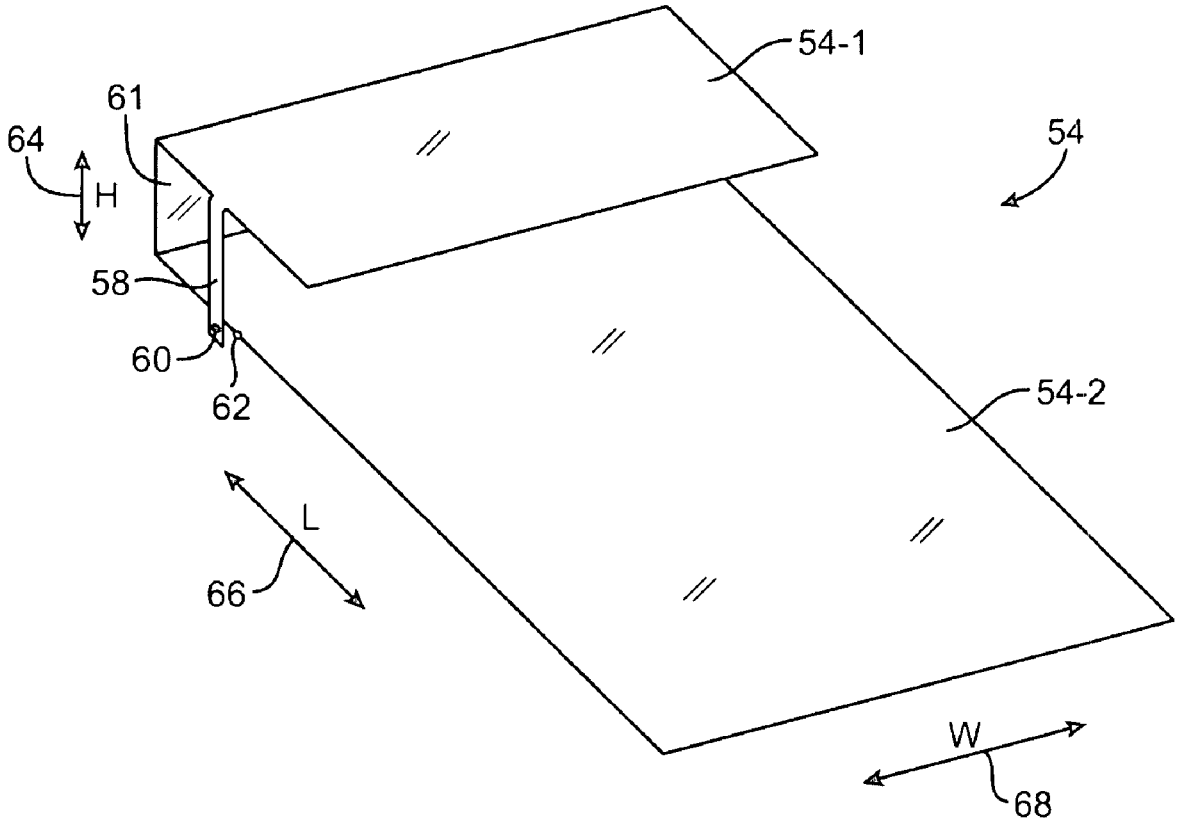
FIG. 4 is a perspective view of an illustrative planar inverted-F antenna (PIFA) in accordance with an embodiment of the present invention.

Antenna 54 may be formed in any suitable shape. With one suitable arrangement, antenna 54 is based at least partly on a planar inverted-F antenna (PIFA) structure. An illustrative PIFA structure that may be used for antenna 54 is shown in FIG. 4. As shown in FIG. 4, PIFA structure 54 has a ground plane portion 54-2 and a planar resonating element portion 54-1. Antennas are fed using positive signals and ground signals. The portion of an antenna to which the positive signal is provided is sometimes referred to as the antenna's positive terminal or feed terminal. This terminal is also sometimes referred to as the signal terminal or the center-conductor terminal. The portion of an antenna to which the ground signal is provided may be referred to as the antenna's ground, the antenna's ground terminal, the antenna's ground plane, etc. In antenna 54 of FIG. 4, feed conductor 58 is used to route positive antenna signals from signal terminal 60 into antenna resonating element 54-1. Ground terminal 62 is shorted to ground plane 54-2, which forms the antenna's ground.

The dimensions of antenna 54 are generally sized to conform to the maximum size allowed by housing 12 of device 10. Antenna ground plane 54-2 may be substantially rectangular in shape having width W in lateral dimension 68 and length L in lateral dimension 66. The length of antenna 54 in dimension 66 affects its frequency of operation. Dimensions 68 and 66 are sometimes referred to as horizontal dimensions. Resonating element 54-1 is typically spaced several millimeters from ground plane 54-2 along vertical dimension 64. The size of antenna 54 in dimension 64 is sometimes referred to as height H of antenna 54.

Figure 5:
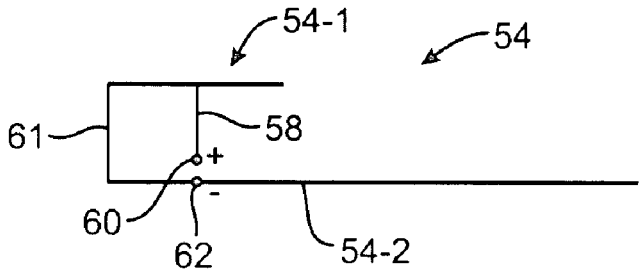
FIG. 5 is a cross-sectional side view of an illustrative planar inverted-F antenna in accordance with an embodiment of the present invention.

A cross-sectional view of antenna 54 is shown in FIG. 5. As shown in FIG. 5, radio-frequency signals may be fed to antenna 54 (when transmitting) and may be received from antenna 54 (when receiving) using signal terminal 60 and ground terminal 62. In a typical arrangement, a coaxial conductor or other transmission line has its center conductor electrically connected to point 60 and its ground conductor electrically connected to point 62.

Figure 6:
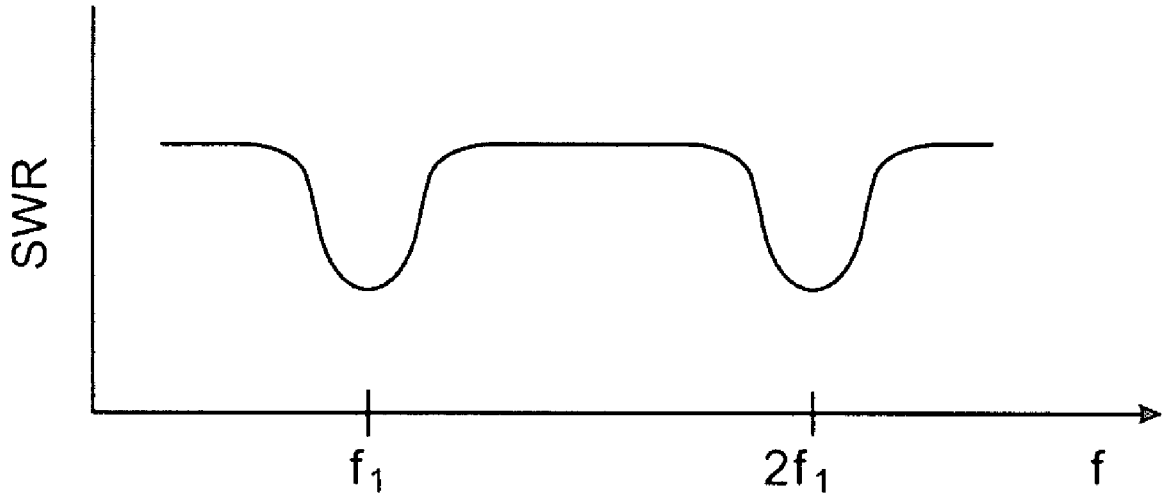
FIG. 6 is an illustrative antenna performance graph for an antenna of the type shown in FIGS. 4 and 5 in which standing-wave-ratio (SWR) values are plotted as a function of operating frequency in accordance with the present invention.

A graph of the expected performance of antenna 54 of FIGS. 4 and 5 is shown in FIG. 6. Expected standing wave ratio (SWR) values are plotted as a function of frequency. As shown, there is a reduced SWR value at frequency $f_1$, indicating that the antenna performs well in the frequency band centered at frequency $f_1$. Antenna 54 may also exhibit a response at harmonic frequencies such as frequency $2f_1$. The harmonic response (if any) may be stronger than the response at $f_1$ or may be weaker than the response at $f_1$. The dimensions of antenna 54 may be selected so that frequencies $f_1$ and $2f_1$ are aligned with a communication bands of interest. The frequency $f_1$ (and, if any, harmonic frequency $2f_1$) may be influenced by the length L of antenna 54 in dimension 66. For operations in a given communications band of interest, it may be advantageous to configure device 10 so that L is approximately equal to one quarter of a wavelength at a frequency f that lies within the communications band.

The height H of antenna 54 of FIGS. 4 and 5 in dimension 64 is limited by the amount of near-field coupling between resonating element 54-1 and ground plane 54-2. For a specified antenna bandwidth and gain, it is not possible to reduce the height H without adversely affecting performance. All other variables being equal, reducing height H will cause the bandwidth and gain of antenna 54 to be reduced.

Figure 7:
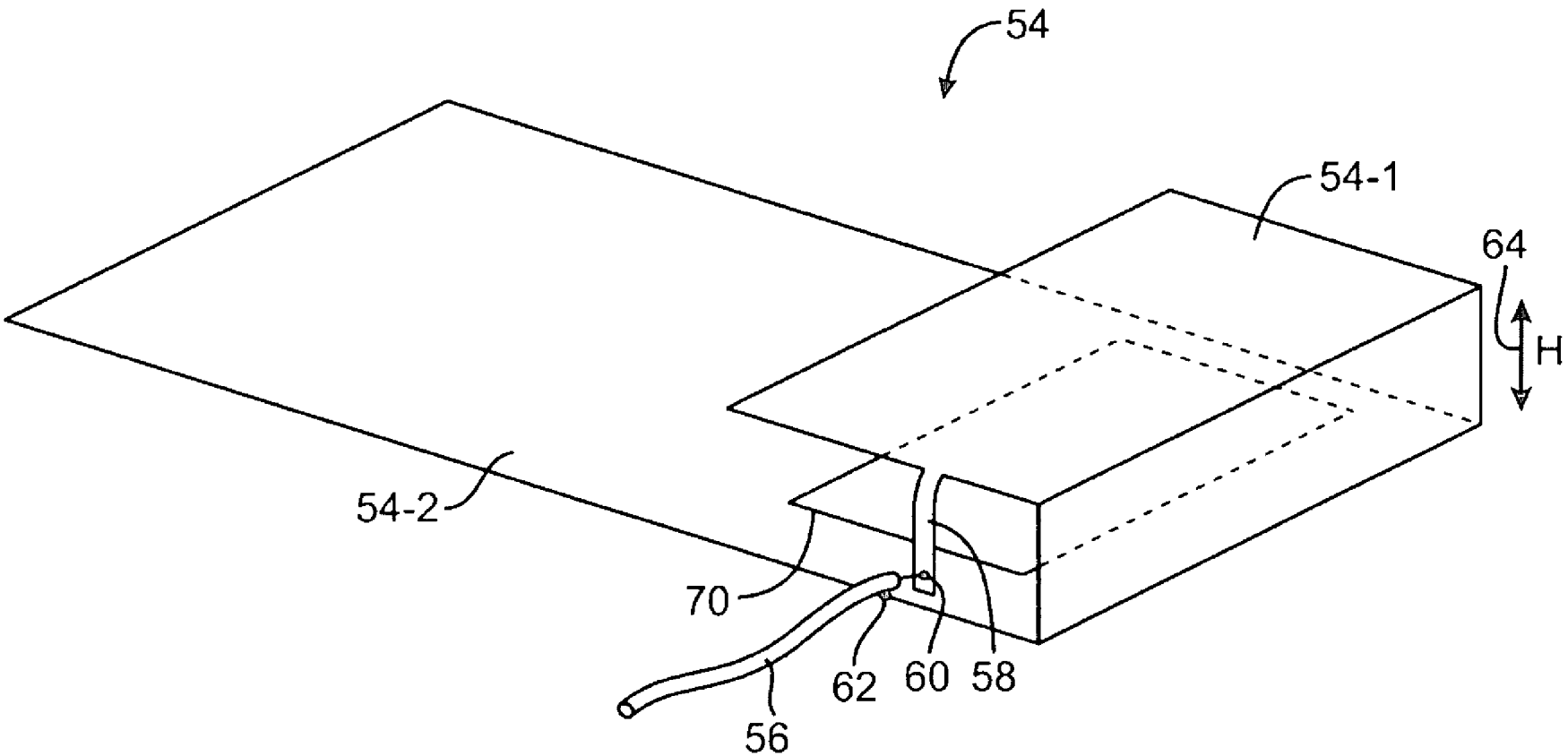
FIG. 7 is a perspective view of an illustrative planar inverted-F antenna in which a portion of the antenna's ground plane underneath the antenna's resonating element has been removed in accordance with an embodiment of the present invention.

As shown in FIG. 7, the minimum vertical dimension of antenna 54 can be reduced while still satisfying minimum bandwidth and gain constraints by introducing a dielectric region 70 in the area under antenna resonating element portion 54-1. The dielectric region 70 may be filled with air, plastic, or any other suitable dielectric and represents a cutaway or removed portion of ground plane 54-2. Removed or empty region 70, which is sometimes referred to as a slot, may be formed from one or more holes in ground plane 54-2. These holes may be square, circular, oval, polygonal, etc. and may extend though adjacent conductive structures in the vicinity of ground plane 54-2. With one suitable arrangement, which is shown in FIG. 7, the removed region 70 is rectangular. This is merely illustrative. Slot 70 may have any suitable shape and may be any suitable size. For example, the slot may be a roughly rectangular opening that is slightly smaller than the outermost rectangular outline of resonating element 54-1. Typical resonating element lateral dimensions are on the order of 0.5 cm to 10 cm.

The presence of slot 70 reduces near-field electromagnetic coupling between resonating element 54-1 and ground plane 54-2 and allows height H in vertical dimension 64 to be made smaller than would otherwise be possible while satisfying a given set of bandwidth and gain constraints. For example, height H may be in the range of 1-5 mm, may be in the range of 2-5 mm, may be in the range of 2-4 mm, may be in the range of 1-3 mm, may be in the range of 1-4 mm, may be in the range of 1-10 mm, may be lower than 10 mm, may be lower than 4 mm, may be lower than 3 mm, may be lower than 2 mm, or may be in any other suitable range of vertical displacements above ground plane element 54-2.

If desired, the portion of antenna 54 that contains slot 70 may be used to form a slot antenna. The slot antenna structure in antenna 54 may be used at the same time as the PIFA structure. Antenna performance can be improved when operating antenna 54 as a hybrid device so that both its PIFA operating characteristics and its slot antenna operating characteristics are obtained.

Figure 8:
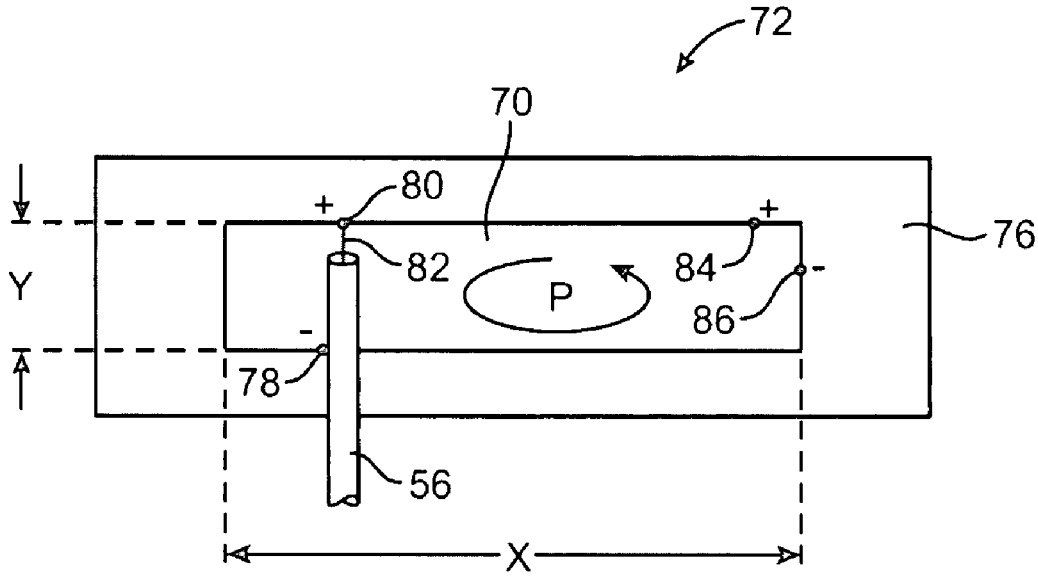
FIG. 8 is a top view of an illustrative slot antenna in accordance with an embodiment of the present invention.

A top view of a slot antenna is shown in FIG. 8. Antenna 72 of FIG. 8 is typically thin in the dimension into the page (i.e., antenna 72 is planar with its plane lying in the page). Slot 70 is formed in the center of antenna 72. Slot 70 of FIG. 8 is shown as being rectangular in shape. This is merely illustrative. Slot 70 may have any suitable shape.

Coaxial cable 56 or other transmission line path may be used to feed antenna 72. In the example of FIG. 8, antenna 72 is fed so that center conductor 82 of coaxial cable 56 is connected to signal terminal 80 (i.e., the positive or feed terminal of antenna 72) and the outer braid of coaxial cable 56, which forms the ground conductor for cable 56, is connected to ground terminal 78.

Figure 9:
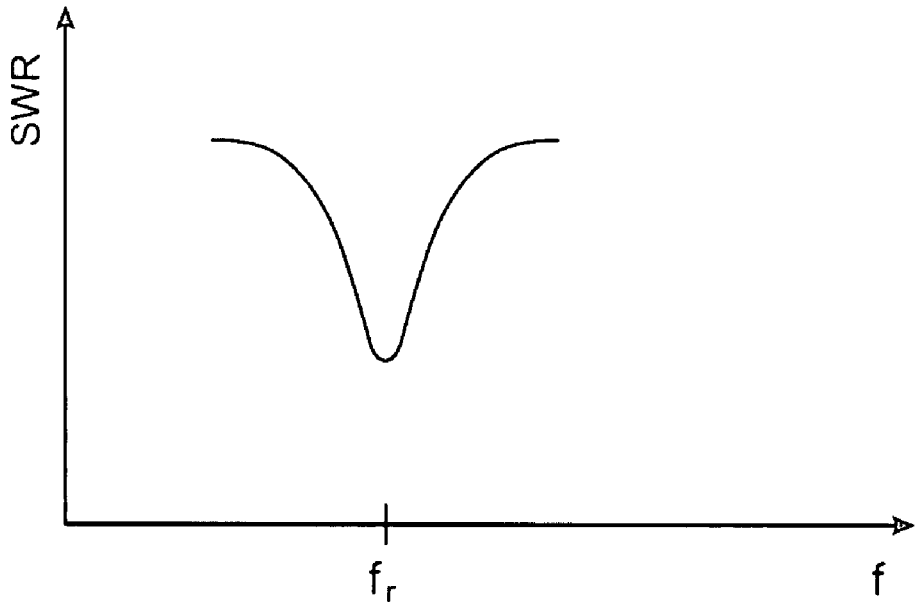
FIG. 9 is an illustrative antenna performance graph for an antenna of the type shown in FIG. 8 in which standing-wave-ratio (SWR) values are plotted as a function of operating frequency.

When antenna 72 is fed using the arrangement of FIG. 8, the antenna's performance is given by the graph of FIG. 9. As shown in FIG. 9, antenna 72 operates in a frequency band that is centered about center frequency $f_r$. The center frequency $f_r$ is determined by the dimensions of slot 70. Slot 70 has an inner perimeter P that is equal to two times dimension X plus two times dimension Y (i.e., P=2X+2Y). At center frequency $f_r$, perimeter P is equal to one wavelength. The position of terminals 80 and 78 may be selected for impedance matching. If desired, terminals such as terminals 84 and 86, which extend around one of the corners of slot 70 may be used to feed antenna 72, provided that the distance between terminals 84 and 86 is chosen to properly adjust the impedance of antenna 72. In the illustrative arrangement of FIG. 8, terminals 84 and 86 are shown as being respectively configured as a slot antenna ground terminal and a slot antenna signal terminal, as an example. If desired, terminal 84 could be used as a ground terminal and terminal 86 could be used as a signal terminal. Slot 70 is typically an air-filled slot, but may, in general, be filled with any suitable dielectric.

Figure 10:
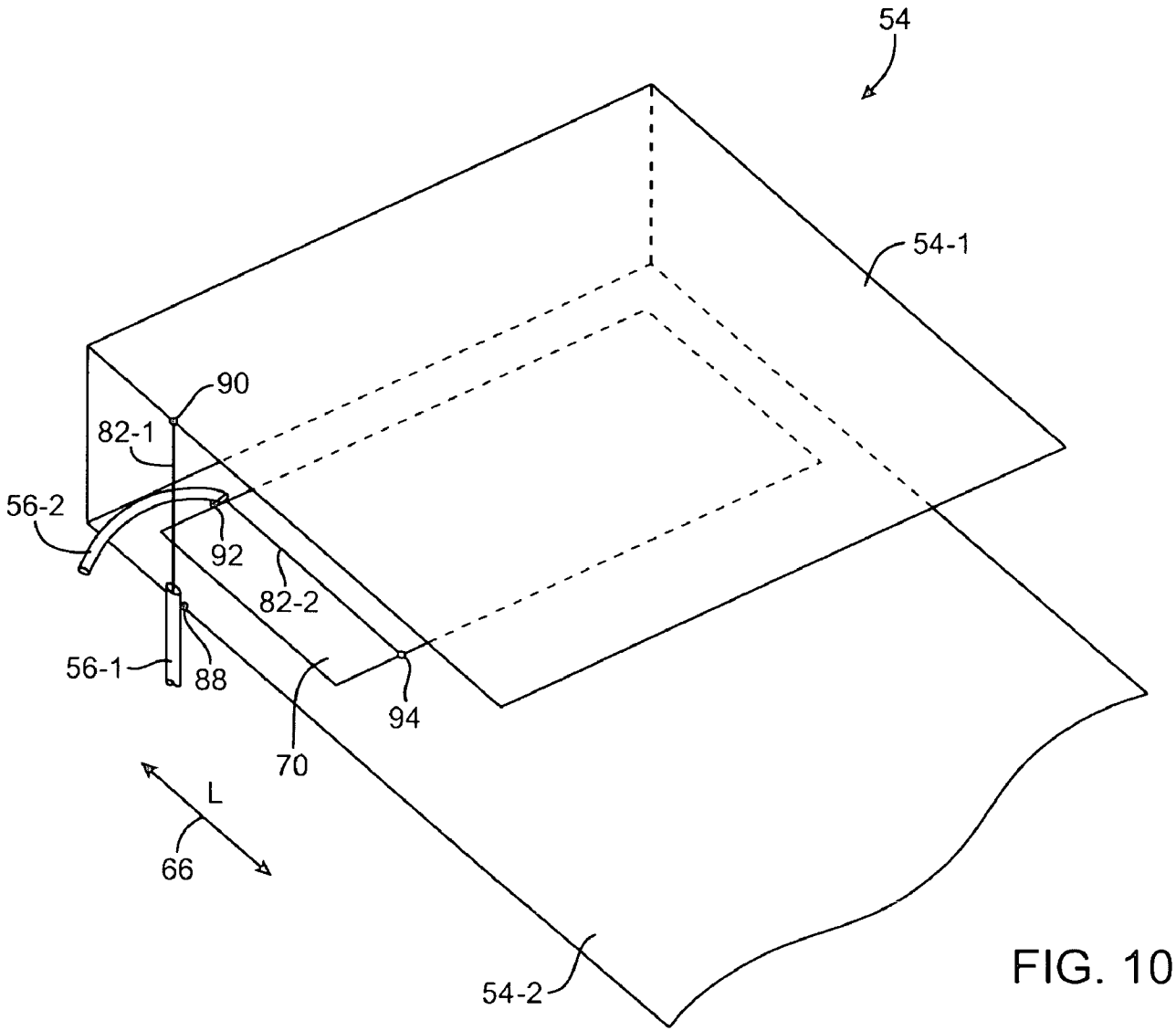
FIG. 10 is a perspective view of an illustrative planar inverted-F antenna in which a portion of the antenna's ground plane underneath the antenna's resonating element has been removed and in which the antenna is shown as being fed by two coaxial cable feeds in accordance with an embodiment of the present invention.

An illustrative configuration in which antenna 54 is fed using two coaxial cables (or other transmission lines) is shown in FIG. 10. When antenna 54 is fed as shown in FIG. 10, both the PIFA and slot antenna portions of antenna 54 are active. As a result, antenna 54 of FIG. 10 operates in a hybrid PIFA/slot mode. Coaxial cables 56-1 and 56-2 have inner conductors 82-1 and 82-2, respectively. Coaxial cables 56-1 and 56-2 also each have a conductive outer braid ground conductor. The outer braid conductor of coaxial cable 56-1 is electrically shorted to ground plane 54-2 at ground terminal 88. The ground portion of cable 56-2 is shorted to ground plane 54-2 at ground terminal 92. The signal connections from coaxial cables 56-1 and 56-2 are made at signal terminals 90 and 94, respectively.

With the arrangement of FIG. 10, two separate sets of antenna terminals are used. Coaxial cable 56-1 feeds the PIFA portion of antenna 54-1 using ground terminal 88 and signal terminal 90 and coaxial cable 56-2 feeds the slot antenna portion of antenna 54 using ground terminal 92 and signal terminal 94. Each set of antenna terminals therefore operates as a separate feed for the antenna. Signal terminal 90 and ground terminal 88 serve as antenna feed points for the PIFA portion of antenna 54, whereas signal terminal 94 and ground terminal 92 serve as antenna feed points for the slot portion of antenna 54. These two separate antenna feeds allow the antenna 54 to function simultaneously using both its PIFA and its slot characteristics. If desired, the orientation of the feeds can be changed. For example, coaxial cable 56-2 may be connected to slot 70 using point 94 as a ground terminal and point 92 as a signal terminal or using ground and signal terminals located at other points along the periphery of slot 70.

Each coaxial cable or other transmission line may terminate at a respective transceiver circuit (also sometimes referred to as a radio) or coaxial cables 56-1 and 56-2 (or other transmission lines) may be connected to switching circuitry that, in turn is connected to one or more radios. When antenna 54 is operated in hybrid PIFA/slot antenna mode, the frequency coverage of antenna 54 and/or its gain at particular frequencies can be enhanced. For example, the additional response provided by the slot antenna portion of antenna 54 may be used to cover one or more frequency bands of interest.

Figure 11:
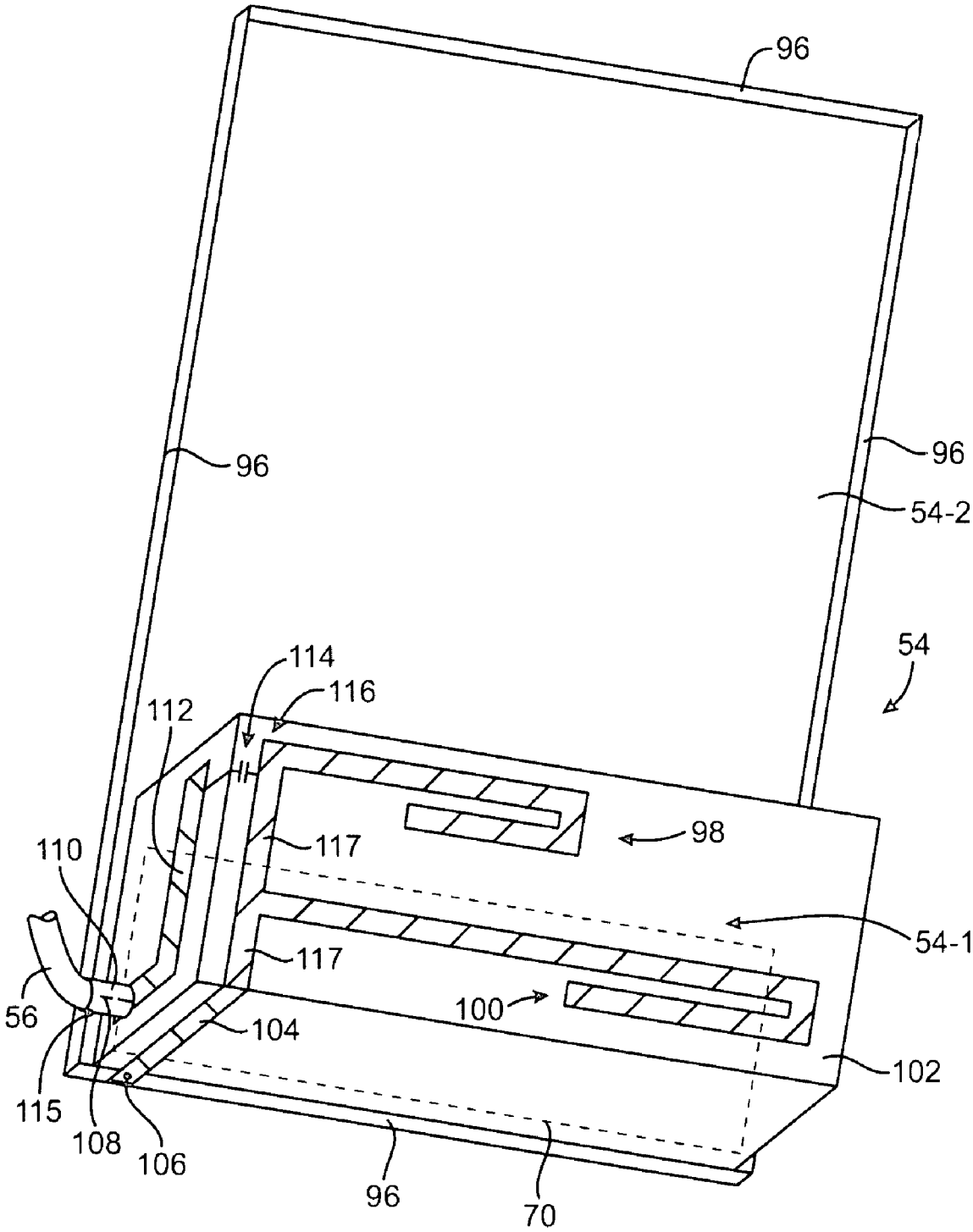
FIG. 11 is a perspective view of an illustrative antenna that has both PIFA and slot antenna characteristics in accordance with an embodiment of the present invention.

If desired, antenna 54 may be fed using a single coaxial cable 56 or other such transmission line. An illustrative configuration for antenna 54 in which a single transmission line is used to simultaneously feed both the PIFA portion and the slot portion of antenna 54 is shown in FIG. 11. As shown in FIG. 11, antenna 54 has ground plane 54-2. Ground plane 54-2 may be formed from conductive structures such as an LCD display, housing wall portions, bezel 14 (FIG. 1), printed circuit boards, etc. Bezel 14 and conductive housing structures may be located around edges 96 of ground plane 54-2.

In the illustrative arrangement shown in FIG. 11, planar antenna resonating element 54-1 has a two-branch F-shaped structure with shorter arm or branch 98 and longer arm or branch 100. This is merely illustrative. The PIFA portion of antenna 54 may use any suitable resonating element configuration. For example, the PIFA portion of antenna 54 may use a planar resonating element structure of the type shown in FIG. 4. Alternatively, a multiarm PIFA resonating element structure may be used that has a different number of branches (e.g., three branches, more than three branches, etc.). The use of a PIFA antenna resonating element structure that is formed with two arms 98 and 100 is shown as an example.

In a multiarm arrangement, the dimensions of the branches of the planar resonating element (e.g., the widths and lengths of branches such as arms 98 and 100 in the example of FIG. 11) may be adjusted to tune the frequency coverage of antenna 54. In general, changes in arm width (the typically narrower lateral dimension of the arm that is perpendicular to its longitudinal axis) will affect the breadth of the antenna resonance associated with the arm, whereas changes in arm length (the typically longer lateral dimension of the arm that is parallel to its longitudinal axis) will affect the position of the antenna resonance. Typical arm widths are on the order of 0.1 cm to 1.0 cm. Typical arm lengths are on the order of 1-10 cm.

As shown in FIG. 11, arms 98 and 100 may be mounted on a support structure 102. Support structure 102 may be formed from one or more pieces of plastic (e.g., ABS plastic) or other suitable dielectric structures. The surfaces of structure 102 may be flat or curved. Arms 98 and 100 may be formed directly on support structure 102 or may be formed on a separate structure such as a flex circuit substrate that is attached to support structure 102 (as examples). Arms such as arms 98 and 100 may be straight, curved, bent, etc.

With one suitable arrangement, resonating element 54-1 is a substantially planar structure that is mounted to an upper surface of support 102. Resonating element 54-1 may be formed by any suitable antenna fabrication technique such as metal stamping, cutting, etching, or milling of conductive tape or other flexible structures, etching metal that has been sputter-deposited on plastic or other suitable substrates, printing from a conducive slurry (e.g., by screen printing techniques), patterning metal such as copper that makes up part of a flex circuit substrate that is attached to support 102 by adhesive, screws, or other suitable fastening mechanisms, etc.

A conductive path such as conductive strip 104 may be used electrically connect the resonating element 54-1 to ground plane 54-2 at terminal 106. A screw or other fastener at terminal 106 may be used to electrically and mechanically connect strip 104 (and therefore resonating element 54-1) to edge 96 of ground plane 54-2. Conductive structures such as strip 104 and other such structures in antenna 54 may also be electrically connected to each other using conductive adhesive.

A coaxial cable such as cable 56 or other transmission line may be connected to the antenna to transmit and receive radio-frequency signals. The coaxial cable or other transmission line may be connected to the structures of antenna 54 using any suitable electrical and mechanical attachment mechanism. As shown in the illustrative arrangement of FIG. 11, mini UFL coaxial connector 110 may be used to connect coaxial cable 56 or other transmission lines to antenna conductor 112. A center conductor of the coaxial cable or other transmission line is connected to center connector 108 of connector 110. The outer braid ground conductor of the coaxial cable is electrically connected to ground plane 54-2 via connector 110 at point 115 (and, if desired, may be shorted to ground plane 54-2 at other attachment points upstream of connector 110).

Conductor 108 may be electrically connected to antenna conductor 112. Conductor 112 may be formed from a conductive element such as a strip of metal formed on a sidewall surface of support structure 102. Conductor 112 may be directly electrically connected to resonating element 54-1 (e.g., at portion 116) or may be electrically connected to resonating element 54-1 through tuning capacitor 114 or other suitable electrical components. The size of tuning capacitor 114 can be selected to tune antenna 54 and ensure that antenna 54 covers the frequency bands of interest for device 10.

Slot 70 may lie beneath resonating element 54-1 of FIG. 11. The signal from center conductor 108 may be routed to point 106 on ground plane 54-2 in the vicinity of slot 70 using a conductive path formed from antenna conductor 112, optional capacitor 114 or other such tuning components, antenna conductor 117, and antenna conductor 104.

The configuration of FIG. 11 allows a single coaxial cable or other transmission line path to simultaneously feed both the PIFA portion and the slot portion of antenna 54.

Grounding point 115 functions as the ground terminal for the slot antenna portion of antenna 54 that is formed by slot 70 in ground plane 54-2. Point 106 serves as the signal terminal for the slot antenna portion of antenna 54. Signals are fed to point 106 via the path formed by conductive path 112, tuning element 114, path 117, and path 104.

For the PIFA portion of antenna 54, point 115 serves as antenna ground. Center conductor 108 and its attachment point to conductor 112 serve as the signal terminal for the PIFA. Conductor 112 serves as a feed conductor and feeds signals from signal terminal 108 to PIFA resonating element 54-1.

In operation, both the PIFA portion and slot antenna portion of antenna 54 contribute to the performance of antenna 54.

The PIFA functions of antenna 54 are obtained by using point 115 as the PIFA ground terminal (as with terminal 62 of FIG. 7), using point 108 at which the coaxial center conductor connects to conductive structure 112 as the PIFA signal terminal (as with terminal 60 of FIG. 7), and using conductive structure 112 as the PIFA feed conductor (as with feed conductor 58 of FIG. 7). During operation, antenna conductor 112 serves to route radio-frequency signals from terminal 108 to resonating element 54-1 in the same way that conductor 58 routes radio-frequency signal from terminal 60 to resonating element 54-1 in FIGS. 4 and 5, whereas conductive line 104 serves to terminate the resonating element 54-1 to ground plane 54-2, as with grounding portion 61 of FIGS. 4 and 5.

The slot antenna functions of antenna 54 are obtained by using grounding point 115 as the slot antenna ground terminal (as with terminal 86 of FIG. 8), using the conductive path formed from antenna conductor 112, tuning element 114, antenna conductor 117, and antenna conductor 104 as conductor 82 of FIG. 8 or conductor 82-2 of FIG. 10, and by using terminal 106 as the slot antenna signal terminal (as with terminal 84 of FIG. 8).

The configuration of FIG. 10 shows that slot antenna ground terminal 92 and PIFA antenna ground terminal 88 may be formed at separate locations on ground plane 54-2. In the configuration of FIG. 11, a single coaxial cable may be used to feed both the PIFA portion of the antenna and the slot portion of the antenna. This is because terminal 115 serves as both a PIFA ground terminal for the PIFA portion of antenna 54 and a slot antenna ground terminal for the slot antenna portion of antenna 54. Because the ground terminals of the PIFA and slot antennas are provided by a common ground terminal structure and because conductive paths 112, 117, and 104 serve to distribute radio-frequency signals to and from the resonating element 54-1 and ground plane 54-2 as needed for PIFA and slot antenna operations, a single transmission line (e.g., coaxial conductor 56) may be used to send and receive radio-frequency signals that are transmitted and received using both the PIFA and slot portions of antenna 54.

If desired, other antenna configurations may be used that support hybrid PIFA/slot operation. For example, the radio-frequency tuning capabilities of tuning capacitor 114 may be provided by a network of other suitable tuning components, such as one or more inductors, one or more resistors, direct shorting metal strip(s), capacitors, or combinations of such components. One or more tuning networks may also be connected to the antenna at different locations in the antenna structure. These configurations may be used with single-feed and multiple-feed transmission line arrangements.

Moreover, the location of the signal terminal and ground terminal in antenna 54 may be different from that shown in FIG. 11. For example, terminals 115/108 and terminal 106 can be moved relative to the locations shown in FIG. 11, provided that the connecting conductors 112, 117, and 104 are suitably modified.

The PIFA portion of antenna 54 can be provided using a substantially rectangular conductor as shown in FIG. 4, or can be provided using other arrangements. For example, resonating element 54-1 may be formed from a non-rectangular planar structure, from a planar structure with a rectangular outline that has one or more serpentine conductive structures within the rectangular outline, or from a slotted non-rectangular or slotted rectangular planar structure.

With one particularly suitable arrangement, resonating element 54-1 may use a multiarm configuration such as the substantially F-shaped conductive element of FIG. 11 that has arms 98 and 100. There may be two, three, or more than three resonating element branches in the multiarm resonating element. Such resonating element branches may be straight, serpentine, curved, or may have any other suitable shape. Use of different shapes for the branches or other portions of resonating element 54-1 helps antenna designers to tailor the frequency response of antenna 54 to its desired frequencies of operation and to otherwise optimize antenna performance.

For example, when it is desired to have a relatively wide frequency response associated with a given antenna branch, the width of that branch may be increased. When it is desired to produce a narrower frequency response, the width of the antenna branch may be reduced. As another example, the position of the antenna response curve that is associated with a particular arm can be adjusted by making adjustments to the length of the arm. In general, peak antenna response for a given branch of the antenna occurs at a frequency at which the length of the antenna branch is equal to one quarter of a wavelength. If it is desired for the resonant peak associated with a given antenna resonating element branch to have a higher frequency, the length of the branch may be decreased. If it is desired for the resonant peak of the antenna resonating element branch to have a lower frequency, the length of the branch may be increased.

Figure 12:
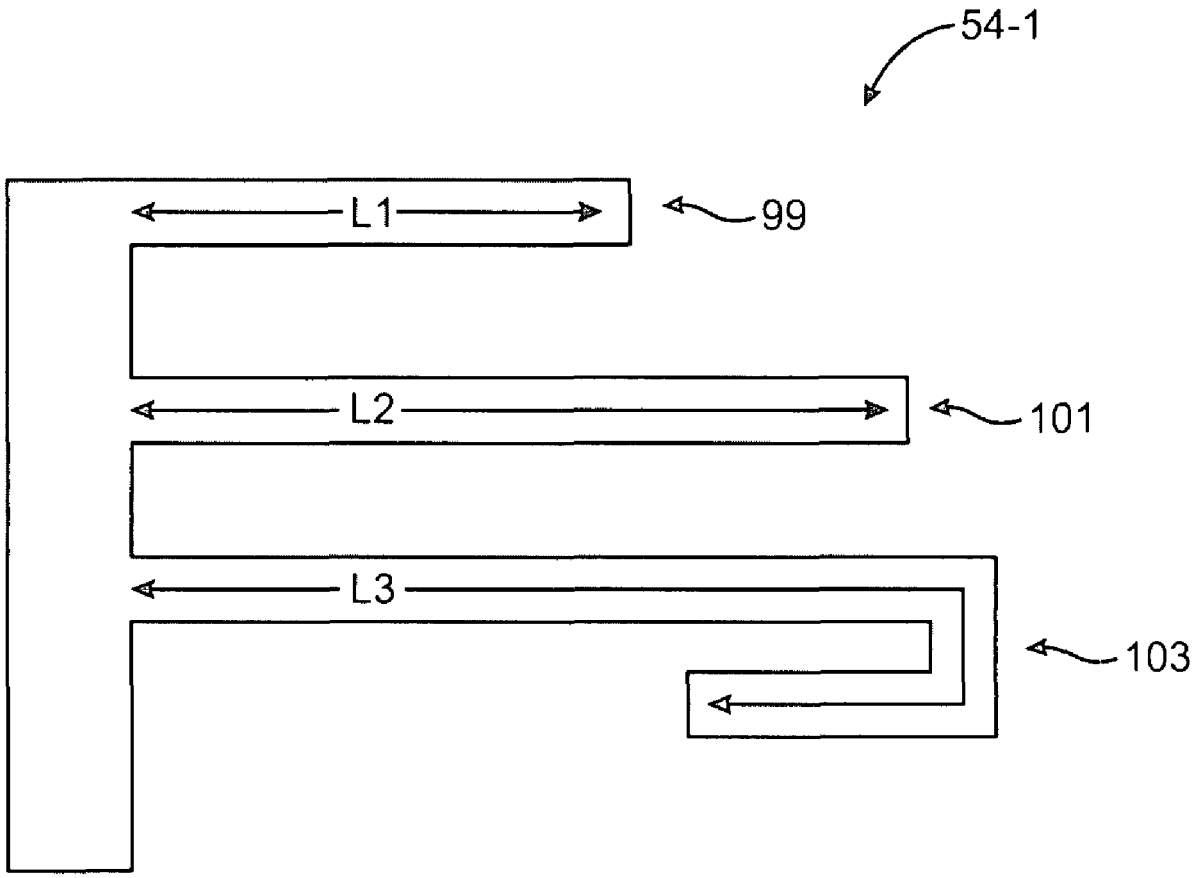
FIG. 12 is a top view of an illustrative three-branch multi-arm PIFA resonating element for a hybrid PIFA-slot antenna in accordance with an embodiment of the present invention.

An illustrative resonating element 54-1 that has three branches is shown in FIG. 12. Branch 99 has length L1. Branch 101 has length L2. Branch 103 has length L3. Branches such as branches 99, 101, and 103 may be straight, curved, bent, serpentine, etc. An advantage of using bends in the branches of resonating element 54-1 (as illustrated by branch 103) is that bent branches are compact and help resonating element 54-1 to fit within device 10.

Figure 13:
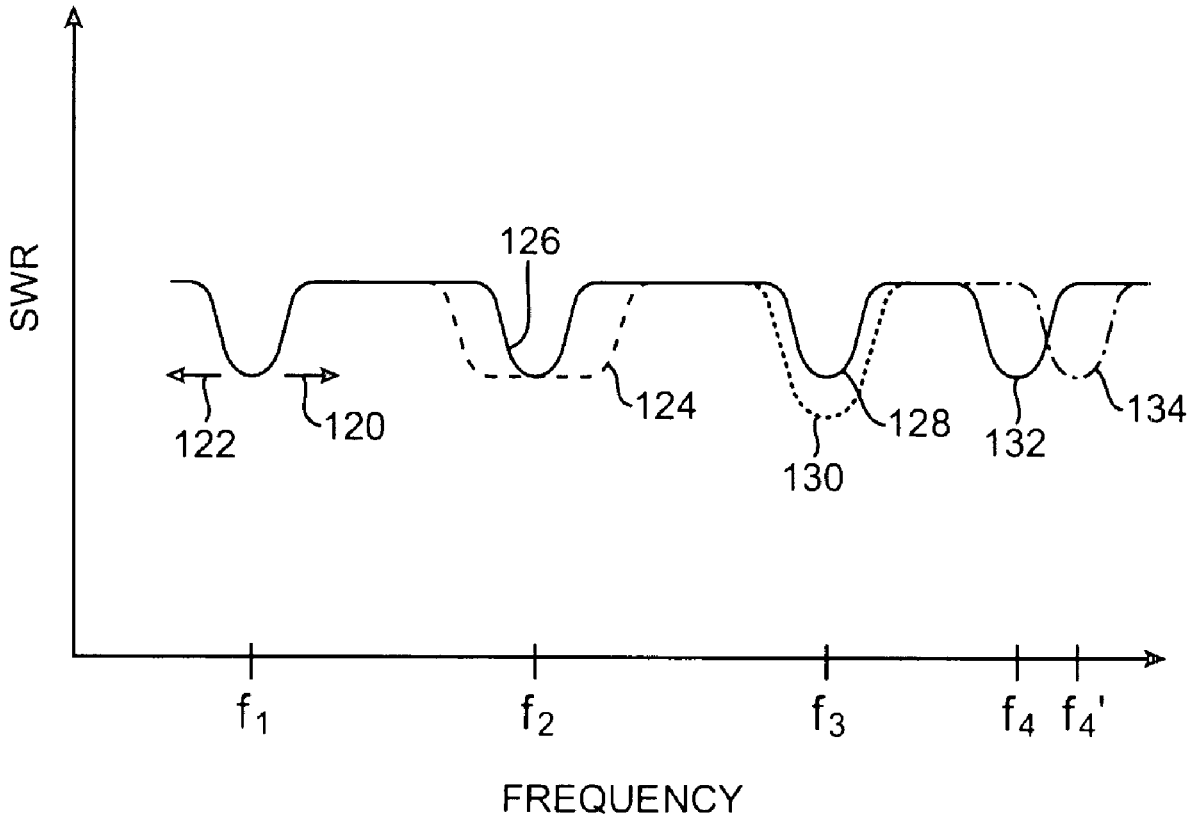
FIG. 13 is a graph of an illustrative antenna performance graph for hybrid PIFA-slot antennas in accordance with embodiments of the present invention in which standing-wave-ratio (SWR) values are plotted as a function of operating frequency.

A graph showing the performance of an illustrative hybrid PIFA-slot antenna with a multibranch resonating element is shown in FIG. 13. In the example of FIG. 13, there are four separate frequency response peaks. This is merely illustrative. A hybrid PIFA-slot antenna such as antenna 54 of device 10 may exhibit any suitable number of frequency peaks.

The response of the antenna may be adjusted to cover desired communications bands of interest.

Consider, as an example, the antenna response peak at frequency $f_1$. This peak may be associated with slot 70 or may be associated with a particular branch of a multibranch resonating element such as arm 98 or arm 100 of FIG. 11 or arm 99, arm 101, or arm 103 of FIG. 12. If the $f_1$ peak is associated with slot 70, the position of the peak may be adjusted to a higher or lower frequency by adjusting the inner perimeter of slot 70, as indicated by arrows 120 and 122. For example, the position of the $f_1$ peak may be shifted to higher frequencies by decreasing the inner perimeter of slot 70 or may be shifted to lower frequencies by increasing the inner perimeter of slot 70. If the $f_1$ peak is associated with a branch of resonating element 54-1, the position of the $f_1$ peak may be shifted to higher frequencies by decreasing the length of the branch or may be shifted to lower frequencies by increasing the length of the branch.

As another example, consider the antenna resonance peak at frequency $f_2$. This frequency peak may correspond to a particular branch of antenna resonating element 54-1. If it is desired to increase the width of the $f_2$ peak, the width of the resonating element branch may be increased. In this situation, the $f_2$ antenna response peak may change from the response indicated by solid line curve 126 to the broader response indicated by dashed line curve 124.

If desired, the frequency peaks from two or more elements of antenna 54 may be aligned. Consider, for example, antenna response peak at frequency $f_3$. This peak may be characterized by solid frequency response line 128. The peak represented by line 128 may be produced by slot 70 or one of the antenna resonating branches. This antenna resonance can be can be strengthened by configuring antenna 54 so that the resonant frequency that is associated with another antenna element coincides with the frequency peak of line 128. For example, if peak 128 is associated with slot 70, one of the resonating element branches can be configured so that its response has the same resonant frequency ($f_3$). In this situation, the combined response of the antenna may be increased, as represented by dotted line 130. Similarly, if peak 128 is associated with one of the branches of the PIFA antenna resonating element in antenna 54, the strength of peak 128 can be increased by configuring slot 70 or one of the other PIFA branches to resonate at $f_3$.

When it is desired to broaden a given communications band or it is desired to cover two adjacent bands, antenna 54 can be configured so that different antenna elements produce adjacent frequency response peaks. As shown by solid line 132 in FIG. 13, antenna 54 may have an antenna resonance at frequency $f_4$. The $f_4$ antenna resonance may correspond to slot 70 or to one of the branches of PIFA resonating element 54-1. Antenna 54 can be configured to cover an additional nearby frequency $f_4'$, as indicated by dashed-and-dotted line 134. If, for example, the $f_4$ peak is being produced by slot 70, the length of one of the branches of resonating element 54-1 can be configured so that the branch produces a resonant peak at $f_4'$. If the $f_4$ peak is being produced by one of the branches of resonating element 54-1, the length of one of the other branches of resonating element 54-1 may be configured to produce a resonant peak at frequency $f_4'$ or the inner perimeter of slot 70 may be configured to produce a resonant peak at $f_4'$.

When it is desired to cover multiple adjacent communications bands of interest with antenna 54 (e.g., GSM and EGSM, UMTS and PCS, or DCS and PCS), an appropriate antenna resonance peak may be broadened sufficiently to cover both bands (e.g., by broadening the resonance peak as described in connection with the $f_2$ peak of FIG. 13, by broadening the resonance peak as described in connection with the $f_4$ resonance peak, by broadening the resonance peak by superimposing a harmonic associated with a lower frequency antenna resonance, or by using more than one of these approaches).

If desired, features such as the broadened peak represented by line 124, the strengthened peak represented by line 130, and the additional peak represented by line 134 may also be produced by a second harmonic (e.g., the frequency $2f_1$ that was described in connection with FIG. 6). Combinations of these approaches may also be used.

Illustrative examples of multiband antenna configurations that may be used for antenna 54 of device 10 are set forth in the tables of FIGS. 14-18. The tables of FIGS. 14 and 15 show illustrative configurations for hybrid PIFA-slot antennas with two-branch multi-arm PIFA resonating elements. The tables of FIGS. 16, 17, and 18 show illustrative configurations for hybrid PIFA-slot antennas with three-branch multi-arm PIFA resonating elements.

In the example of FIG. 14, antenna 54 has a two-branch resonating element 54-1. The first branch of antenna resonating element 54-1 (e.g., branch 98 of FIG. 11) may be configured to cover both the UMTS and PCS communications bands. Slot 70 may be configured to cover the DCS band. The second branch of antenna resonating element 54-1 (e.g., branch 100 of FIG. 11) may be configured to cover both the GSM and EGSM bands. An antenna with this type of arrangement may be considered to cover five bands (UMTS, PCS, DCS, GSM, and EGSM).

In the example of FIG. 15, antenna 54 also has a two-branch resonating element 54-1. In the FIG. 15 arrangement, slot 70 has been configured to cover the UMTS communications band. The first branch of antenna resonating element 54-1 (e.g., branch 98 of FIG. 11) has been configured to cover both the DCS and PCS communications bands. The second branch of antenna resonating element 54-1 (e.g., branch 100 of FIG. 11) has been configured to cover both the GSM and EGSM bands. As with the arrangement of FIG. 14, the antenna arrangement of FIG. 15 may be considered to cover five bands (UMTS, PCS, DCS, GSM, and EGSM).

The table of FIG. 16 corresponds to an illustrative configuration for antenna 54 in which antenna resonating element 54-1 has a three-branch resonating element such as antenna resonating element 54-1 of FIG. 12. As shown in FIG. 16, the first branch of antenna resonating element 54-1 (e.g., branch 99 of FIG. 12) may be configured to cover the UMTS communications band. The second branch of antenna resonating element 54-1 (e.g., branch 101 of FIG. 12) may be configured to cover the PCS communications band. Slot 70 may be configured to cover the DCS communications band. The GSM and EGSM communications bands may be covered by the third branch of antenna resonating element 54-1 (e.g., branch 103 of FIG. 12). The antenna configuration of FIG. 16 can be used to cover five communications bands (UMTS, PCS, DCS, GSM, and EGSM).

The table of FIG. 17 corresponds to another illustrative configuration for antenna 54 in which antenna resonating element 54-1 has a three-branch resonating element such as antenna resonating element 54-1 of FIG. 12. As shown in the table of FIG. 17, the first branch of antenna resonating element 54-1 (e.g., branch 99 of FIG. 12) may be configured to cover the UMTS communications band. Slot 70 may be configured to cover the PCS communications band. The second branch of antenna resonating element 54-1 (e.g., branch 101 of FIG. 12) may be configured to cover the DCS communications band. The third branch of antenna resonating element 54-1 may be configured to cover both the GSM and EGSM communications bands (e.g., branch 103 of FIG. 12). As with the three-branch antenna configuration of FIG. 16, the three-branch antenna configuration of FIG. 17 can be used to cover five communications bands (UMTS, PCS, DCS, GSM, and EGSM).

In antenna arrangements of the type described in connection with FIGS. 14, 15, 16, and 17, the highest communications band covered is UMTS (2170 MHz). In these designs, optional higher band antennas (e.g., for Bluetooth and WiFi at 2.4 GHz) may be provided in device 10. For example, a 2.4 GHz antenna may be provided in the top portion of housing 12 in device 10 (i.e., at the opposite end of housing 12 from antenna 54).

Another suitable arrangement for covering additional communications bands such as the WiFi/Bluetooth band at 2.4 GHz is shown in the table of FIG. 18. With the arrangement of FIG. 18, six communications bands of interest are covered (WiFi, UMTS, PCS, DCS, GSM, and EGSM). Slot 70 may, as an example, be configured to cover the WiFi (and Bluetooth) communications band at 2.4 GHz. The first branch of antenna resonating element 54-1 (e.g., branch 99 of FIG. 12) may be configured to cover the UMTS communications band. The second branch of antenna resonating element 54-1 (e.g., branch 101 of FIG. 12) may be configured to cover both the DCS and PCS communications band. The third branch of antenna resonating element 54-1 (e.g., branch 103 of FIG. 12) may be configured to cover both the GSM and EGSM communications bands.

As with the five band antenna arrangements described in connection with FIGS. 14-17, a six band antenna arrangement may be used in a handheld device that has one or more additional antennas for covering different communications bands. For example, another antenna resonating element (e.g., an antenna resonating element at the opposite end of housing 12) may be used to cover a 5 GHz band. Moreover, the GPS band at 1550 MHz can be covered (e.g., with an additional antenna in device 10 or by ensuring that one of the resonating element branches of resonating element 54-1 or slot 70 of hybrid PIFA-slot antenna 54 has an antenna resonance at 1550 MHz).

The foregoing is merely illustrative of the principles of this invention and various modifications can be made by those skilled in the art without departing from the scope and spirit of the invention.

What is claimed is:

1. A hybrid handheld electronic device antenna with characteristics of both a planar inverted-F antenna and a slot antenna, comprising:

a ground plane antenna element having portions that define a dielectric-filled slot associated with the slot antenna, wherein the slot is a closed slot that has a periphery that is completely surrounded by the portions of the ground plane antenna element; and a planar antenna resonating element that is located above the slot and that is associated with the planar inverted-F antenna, wherein the slot antenna is configured to operate in a first communications band, wherein the planar antenna resonating element comprises a first antenna resonating element branch that is configured to operate in a second communications band that is different than the first communications band, and wherein the planar antenna resonating element comprises a second antenna resonating element branch that is configured to operate in a third communications band that is different than the first communications band and the second communications band.

2. The hybrid handheld electronic device antenna defined in claim 1 wherein the slot antenna is configured to operate in a Digital Cellular System (DCS) communications band at 1800 MHz.

3. The hybrid handheld electronic device antenna defined in claim 1 wherein the first antenna resonating element branch is configured to operate in a Universal Mobile Telecommunications System (UMTS) communications band at 2170 MHz and a Personal Communications Service (PCS) band at 1900 MHz.

4. The hybrid handheld electronic device antenna defined in claim 1 wherein the second antenna resonating element branch is configured to operate in an Global System for Mobile (GSM) communications band at 850 MHz and an Extended Global System for Mobile (EGSM) communications band at 900 MHz.

5. The hybrid handheld electronic device antenna defined in claim 1 wherein the slot antenna is configured to operate in a Digital Cellular System (DCS) communications band at 1800 MHz and wherein the first antenna resonating element branch is configured to operate in a Universal Mobile Telecommunications System (UMTS) communications band at 2170 MHz and a Personal Communications Service (PCS) band at 1900 MHz.

6. The hybrid handheld electronic device antenna defined in claim 1 wherein the slot antenna is configured to operate in a Digital Cellular System (DCS) communications band at 1800 MHz and wherein the second antenna resonating element branch is configured to operate in a Global System for Mobile (GSM) communications band at 850 MHz and a Extended Global System for Mobile (EGSM) communications band at 900 MHz.

7. The hybrid handheld electronic device antenna defined in claim 1 wherein the slot antenna is configured to operate in a Digital Cellular System (DCS) communications band at 1800 MHz, wherein the first antenna resonating element branch is configured to operate in a Universal Mobile Telecommunications System (UMTS) communications band at 2170 MHz and a Personal Communications Service (PCS) band at 1900 MHz, and wherein the second antenna resonating element branch is configured to operate in a Global System for Mobile (GSM) communications band at 850 MHz and a Extended Global System for Mobile (EGSM) communications band at 900 MHz.

8. The hybrid handheld electronic device antenna defined in claim 1 wherein the first antenna resonating element branch is configured to operate in a Universal Mobile Telecommunications System (UMTS) communications band at 2170 MHz and a Personal Communications Service (PCS) band at 1900 MHz and wherein the second antenna resonating element branch is configured to operate in a Global System for Mobile (GSM) communications band at 850 MHz and a Extended Global System for Mobile (EGSM) communications band at 900 MHz.

9. The hybrid handheld electronic device antenna defined in claim 1 wherein the slot antenna is configured to operate in a Universal Mobile Telecommunications System (UMTS) communications band at 2170 MHz.

10. The hybrid handheld electronic device antenna defined in claim 1 wherein the first antenna resonating element branch is configured to operate in a Digital Cellular System (DCS) communications band at 1800 MHz and a Personal Communications Service (PCS) band at 1900 MHz.

11. The hybrid handheld electronic device antenna defined in claim 1 wherein the slot antenna is configured to operate in a Universal Mobile Telecommunications System (UMTS) communications band at 2170 MHz and wherein the first antenna resonating element branch is configured to operate in a Digital Cellular System (DCS) communications band at 1800 MHz and a Personal Communications Service (PCS) band at 1900 MHz.

12. The hybrid handheld electronic device antenna defined in claim 1 wherein the slot antenna is configured to operate in a Universal Mobile Telecommunications System (UMTS) communications band at 2170 MHz and wherein the second antenna resonating element branch is configured to operate in a Global System for Mobile (GSM) communications band at 850 MHz and a Extended Global System for Mobile (EGSM) communications band at 900 MHz.

13. The hybrid handheld electronic device antenna defined in claim 1 wherein the slot antenna is configured to operate in a Universal Mobile Telecommunications System (UMTS) communications band at 2170 MHz, wherein the first antenna resonating element branch is configured to operate in a Digital Cellular System (DCS) communications band at 1800 MHz and a Personal Communications Service (PCS) band at 1900 MHz, and wherein the second antenna resonating element branch is configured to operate in a Global System for Mobile (GSM) communications band at 850 MHz and a Extended Global System for Mobile (EGSM) communications band at 900 MHz.

14. The hybrid handheld electronic device antenna defined in claim 1 wherein the first antenna resonating element branch is configured to operate in a Digital Cellular System (DCS) communications band at 1800 MHz and a Personal Communications Service (PCS) band at 1900 MHz and wherein the second antenna resonating element branch is configured to operate in a Global System for Mobile (GSM) communications band at 850 MHz and a Extended Global System for Mobile (EGSM) communications band at 900 MHz.

15. A hybrid handheld electronic device antenna with characteristics of both a planar inverted-F antenna and a slot antenna, comprising:

a ground plane antenna element having portions that define a dielectric-filled slot associated with the slot antenna, wherein the slot is a closed slot that has a periphery that is completely surrounded by the portions of the ground plane antenna element;

a planar antenna resonating element that is located above the slot and that is associated with the planar inverted-F antenna, wherein the slot antenna is configured to operate in a first communications band, wherein the planar antenna resonating element comprises a first antenna resonating element branch that is configured to operate in a second communications band that is different than the first communications band, and wherein the planar antenna resonating element comprises a second antenna resonating element branch that is configured to operate in a third communications band that is different than the first communications band and the second communications band;

a first pair of antenna terminals through which a first transmission line conveys radio-frequency signals for the slot antenna; and a second pair of antenna terminals through which a second transmission line that is different than the first transmission line conveys radio-frequency signals for the planar antenna resonating element.

16. The hybrid handheld electronic device antenna defined in claim 15 wherein the planar antenna resonating element comprises a third antenna resonating element branch that is configured to operate in a fourth communications band that is different than the first communications band, the second communications band, and the third communications band, wherein the slot antenna is configured to operate in a Digital Cellular System (DCS) communications band at 1800 MHz, wherein the first antenna resonating element branch is configured to operate in a Universal Mobile Telecommunications System (UMTS) communications band at 2170 MHz, wherein the second antenna resonating element branch is configured to operate in a Personal Communications Service (PCS) band at 1900 MHz, and wherein the third antenna resonating element branch is configured to operate in a Global System for Mobile (GSM) communications band at 850 MHz and a Extended Global System for Mobile (EGSM) communications band at 900 MHz.

17. The hybrid handheld electronic device antenna defined in claim 15 wherein the planar antenna resonating element comprises a third antenna resonating element branch that is configured to operate in a fourth communications band that is different than the first communications band, the second communications band, and the third communications band, wherein the slot antenna is configured to operate in a Personal Communications Service (PCS) band at 1900 MHz, wherein the first antenna resonating element branch is configured to operate in a Universal Mobile Telecommunications System (UMTS) communications band at 2170 MHz, wherein the second antenna resonating element branch is configured to operate in a Digital Cellular System (DCS) communications band at 1800 MHz, and wherein the third antenna resonating element branch is configured to operate in a Global System for Mobile (GSM) communications band at 850 MHz and a Extended Global System for Mobile (EGSM) communications band at 900 MHz.

18. The hybrid handheld electronic device antenna defined in claim 15 wherein the planar antenna resonating element comprises a third antenna resonating element branch that is configured to operate in a fourth communications band that is different than the first communications band, the second communications band, and the third communications band, wherein the first antenna resonating element branch is configured to operate in a Universal Mobile Telecommunications System (UMTS) communications band at 2170 MHz, wherein the third antenna resonating element branch is configured to operate in a Global System for Mobile (GSM) communications band at 850 MHz and a Extended Global System for Mobile (EGSM) communications band at 900 MHz, and wherein the slot antenna is configured to operate in a communications band selected from the group consisting of: a Personal Communications Service (PCS) band at 1900 MHz and a Digital Cellular System (DCS) communications band at 1800 MHz.

19. A hybrid handheld electronic device antenna with characteristics of both a planar inverted-F antenna and a slot antenna, comprising:

a ground plane antenna element having portions that define a dielectric-filled slot associated with the slot antenna;

a planar antenna resonating element that is located above the slot and that is associated with the planar inverted-F antenna, wherein the slot antenna is configured to operate in a first communications band at 2.4 GHz, wherein the planar antenna resonating element comprises a first antenna resonating element branch that is configured to operate in a second communications band that is different than the first communications band, and wherein the planar antenna resonating element comprises a second antenna resonating element branch that is configured to operate in a third communications band that is different than the first communications band and the second communications band;

a first terminal connected to a signal conductor in a transmission line that conveys radio-frequency signals between the hybrid handheld electronic device antenna and transceiver circuitry;

a ground terminal that is electrically connected to the ground plane antenna element and a ground conductor in the transmission line;

a second terminal that is connected to the ground plane antenna element at a location different from the ground terminal;

a first antenna conductive path is electrically connected to the first terminal; and a second antenna conductive path is electrically connected to the second terminal, wherein the first antenna conductive path and the second antenna conductive path convey signals between the first terminal and the second terminal.

20. The hybrid handheld electronic device antenna defined in claim 19 wherein the planar antenna resonating element comprises a third antenna resonating element branch that is configured to operate in a fourth communications band that is different than the first communications band, the second communications band, and the third communications band, wherein the first antenna resonating element branch is configured to operate in a Universal Mobile Telecommunications System (UMTS) communications band at 2170 MHz, wherein the second antenna resonating element branch is configured to operate in a Digital Cellular System (DCS) communications band at 1800 MHz and a Personal Communications Service (PCS) band at 1900 MHz, and wherein the third antenna resonating element branch that is configured to operate in a Global System for Mobile (GSM) communications band at 850 MHz and a Extended Global System for Mobile (EGSM) communications band at 900 MHz.

21. The hybrid handheld electronic device antenna defined in claim 19 further comprising a tuning element, wherein the first and second antenna conductive paths are coupled together through the tuning element, wherein the first terminal and the ground terminal serve as antenna feed points for the planar-inverted-F antenna, and wherein the ground terminal and the second terminal serve as antenna feed points for the slot antenna.

22. The hybrid handheld electronic device antenna defined in claim 19 further comprising a capacitor, wherein the first and second antenna conductive paths are coupled together through the capacitor.

* * * * *

UNITED STATES PATENT AND TRADEMARK OFFICE

CERTIFICATE OF CORRECTION

PATENT NO. : 7,864,123 B2
APPLICATION NO. : 11/897033
DATED : January 4, 2011
INVENTOR(S) : Robert J. Hill et al.

It is certified that error appears in the above-identified patent and that said Letters Patent is hereby corrected as shown below:

In column 8, line 62, delete “phonolic” and insert -- phenolic --, therefor.

Signed and Sealed this
First Day of November, 2011

David J. Kappos

David J. Kappos
*Director of the United States Patent and Trademark Office*